US006193045B1

(12) United States Patent
Ishida et al.

(10) Patent No.: US 6,193,045 B1
(45) Date of Patent: Feb. 27, 2001

(54) COIN PULLOUT PREVENTION LEVER OF COIN SORTING DEVICE

(75) Inventors: Takeshi Ishida, Sakado; Jun Yamada, Kawagoe; Masato Yagi, Urawa, all of (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/524,068

(22) Filed: Mar. 13, 2000

(30) Foreign Application Priority Data

Mar. 11, 1999 (JP) ..... 11-064896

(51) Int. Cl.[7] ..... G07D 7/00
(52) U.S. Cl. ..... 194/203

(58) Field of Search ..... 194/203

(56) References Cited

U.S. PATENT DOCUMENTS

| | | | | |
|---|---|---|---|---|
| 4,243,133 | * | 1/1981 | Nicolaus | 194/203 |
| 4,327,824 | * | 5/1982 | Nicholson | 194/203 |
| 5,007,079 | * | 4/1991 | Vogl et al. | 194/203 |
| 5,769,200 | * | 6/1998 | Meyer et al. | 194/203 |

* cited by examiner

*Primary Examiner*—Robert P. Olszewski
*Assistant Examiner*—Bryan Jaketic
(74) *Attorney, Agent, or Firm*—Hogan & Hartson, LLP.

(57) ABSTRACT

Around one coin pullout prevention lever, another coin pullout prevention lever with tip position thereof being different from that of the one coin pullout prevention lever is arranged.

4 Claims, 12 Drawing Sheets

COIN PULLOUT PREVENTION LEVER OF COIN SORTING DEVICE

TECHNICAL FILED

The present invention relates to an improvement of a coin pullout prevention lever for preventing the back-flow of coins that have been inserted into a coin sorting device.

BACKGROUND ART

Conventionally, coin sorting devices discriminate inserted coins as genuine and counterfeit, and classify genuine coins according to their denomination, and sort out the genuine coins by distributing them into predetermined coin paths. In such conventional coin sorting devices, a coin pullout prevention lever is provided as a countermeasure against preventing mischievous pulling out of inserted coins.

FIG. 6 is a front view of a gate plate 2, showing the main parts of a coin sorting device equipped with a conventional coin pullout prevention lever.

This gate plate 2 constitutes one side wall 4*a* of a coin guiding passage 4 for guiding coins that have been inserted into coin insertion port 3 towards the left in the drawing. The gate plate 2, which can freely be opened and closed, covers the upper portion of a main plate (not shown in the drawings), which is part of the main body of the coin sorting device, and arranged in opposition to the gate plate 2.

The gate plate 2 is hinged on a shaft 5 and it can be opened and closed with respect to the main plate (not shown in the drawings) arranged in opposition to its main surface, so that when coins are stuck in the coin guiding passage 4, the coin guiding passage can be opened, and the stuck coins can be removed.

A coin pullout prevention lever 1 is arranged downstream of the coin guiding passage 4, so as to effectively prevent mischievous pulling out of inserted coins by force with some means such as a string.

This coin pullout prevention lever 1 is one lever that is rotatably supported by a shaft (not shown in the drawings) on the rear surface of the gate plate 2, and in its initial position, its tip 1a protrudes due to its own weight towards the main plate (not shown in the drawings), which is arranged in opposition to the front surface of the gate plate 2.

A pass sensor 6 for detecting coins falling down from the downstream of the coin guiding passage 4 is arranged in the main plate positioned below the coin pullout prevention lever 1. When an inserted coin is detected by this pass sensor 6, the coin is regarded as a deposit in the coin sorting device.

Numeral 7 in FIG. 6 is a coin discrimination device, for discriminating the inserted coins into genuine and counterfeit, and for classifying them according to denominations. This coin discrimination device 7 includes an oscillation coil and a receiving coil arranged in opposition to one another at a certain interval. One of the oscillation coil and the receiving coil is arranged on the rear surface of the gate plate 2, and the other one is arranged on the rear surface of the main plate (not shown in the drawings) at a position opposing the gate plate 2.

Further, in FIG. 6, numeral 8 is a gate rail arranged below the coin insertion port 3, numeral 9 is a guide rail, which makes up the bottom of the coin passage 4, and numeral 10 denotes concave positioning members formed along an advance direction of the coin passage 4, which decrease the areal contact with the inserted coin, and smoothly guide the coin. Numeral 60 in FIG. 6 denotes liquid discharge holes for discharging liquids (such as water) that have been introduced through the coin insertion port 3.

With this coin pullout prevention lever 1, when an inserted coin A, to which a string 11 has been tied, rolls down the coin guiding passage 4, falls down from the downstream edge of the coin guiding passage 4, and is detected by the pass sensor 6 as shown in FIG. 7, and if anyone tries to pull the coin A back out again with the string 11, as shown in FIG. 8, the coin A engages with a tip rear face 1*b* of the coin pullout prevention lever 1, so that it can be prevented from being pulled back out.

Needless to say that when the coin A engages with the tip rear face 1*b* of the coin pullout prevention lever 1, the tip 1*a* of the coin pullout prevention lever 1 abuts the opposing main plate (not shown in the drawings), so that the rotation is blocked.

In this conventional coin pullout prevention lever 1, the distance L from the tip 1*a* of the coin pullout prevention lever 1 to the pass sensor 6 is constant, as shown in FIG. 6. Thus, if a coin B with a diameter larger than the distance L is inserted as shown in FIG. 9, it occurs that even when the sensor 6 confirms the insertion of the coin B, the coin B still has not moved completely downward from the tip 1*a* of the coin pullout prevention lever 1.

In this case, the coin B, whose insertion has been confirmed by the pass sensor 6, still pushes the tip 1*a* of the coin pullout prevention lever 1 towards the gate plate 2, and therefore the coin B does not engage the tip rear face 1*b* of the coin pullout prevention lever 1. Consequently, if in this situation the coin B is pulled up again with a string 11, there is the problem that the coin B can be pulled back out through the con insertion port 3.

To solve this problem, the distance L' from the lower edge 1*a* of the coin pullout prevention lever 1 to the pass sensor 6 is set to be larger than the diameter of the larger coin B, as shown in FIG. 11, then the entire coin B will have moved completely downward from the tip 1*a* of the coin pullout prevention lever 1 when its insertion is being confirmed by the pass sensor 6. As a result, if one tries to pull the coin B back out with the string 11, the coin B engages the tip rear face 1*b* of the coin pullout prevention lever 1 as shown in FIG. 12, and its backflow is prevented, thereby preventing the pullout of the coin B.

However, to set the distance L' from the lower edge 1*a* of the coin pullout prevention lever 1 to the pass sensor 6 larger than the diameter of the larger coin B, as shown in FIG. 11, that is, larger than the distance L in FIG. 6 (L'>L), the design of the entire main plate of the coin sorting device has to be changed considerably. This makes it necessary to provide different types of coin sorting devices with pass sensors 6 that are arranged at different positions depending on the diameter of the coins whose pulling out is to be prevented, which results in a considerable increase of cost for manufacturing coin sorting devices.

In view of these problems, it is an object of the invention to present a coin pullout prevention lever that prevents the pulling out of coins with various diameters without altering the basic design of a coin sorting device.

DISCLOSURE OF INVENTION

To solve the aforementioned problems, a coin pullout prevention lever of the present invention is provided with, around one coin pullout prevention lever, another coin pullout prevention lever with tip position thereof being different from that of the one coin pullout prevention lever is arranged.

BEST MODE FOR CARRYING OUT THE INVENTION

The following is a detailed description of a preferred embodiment of a coin pullout prevention lever in accordance with the present invention.

Figure 1:
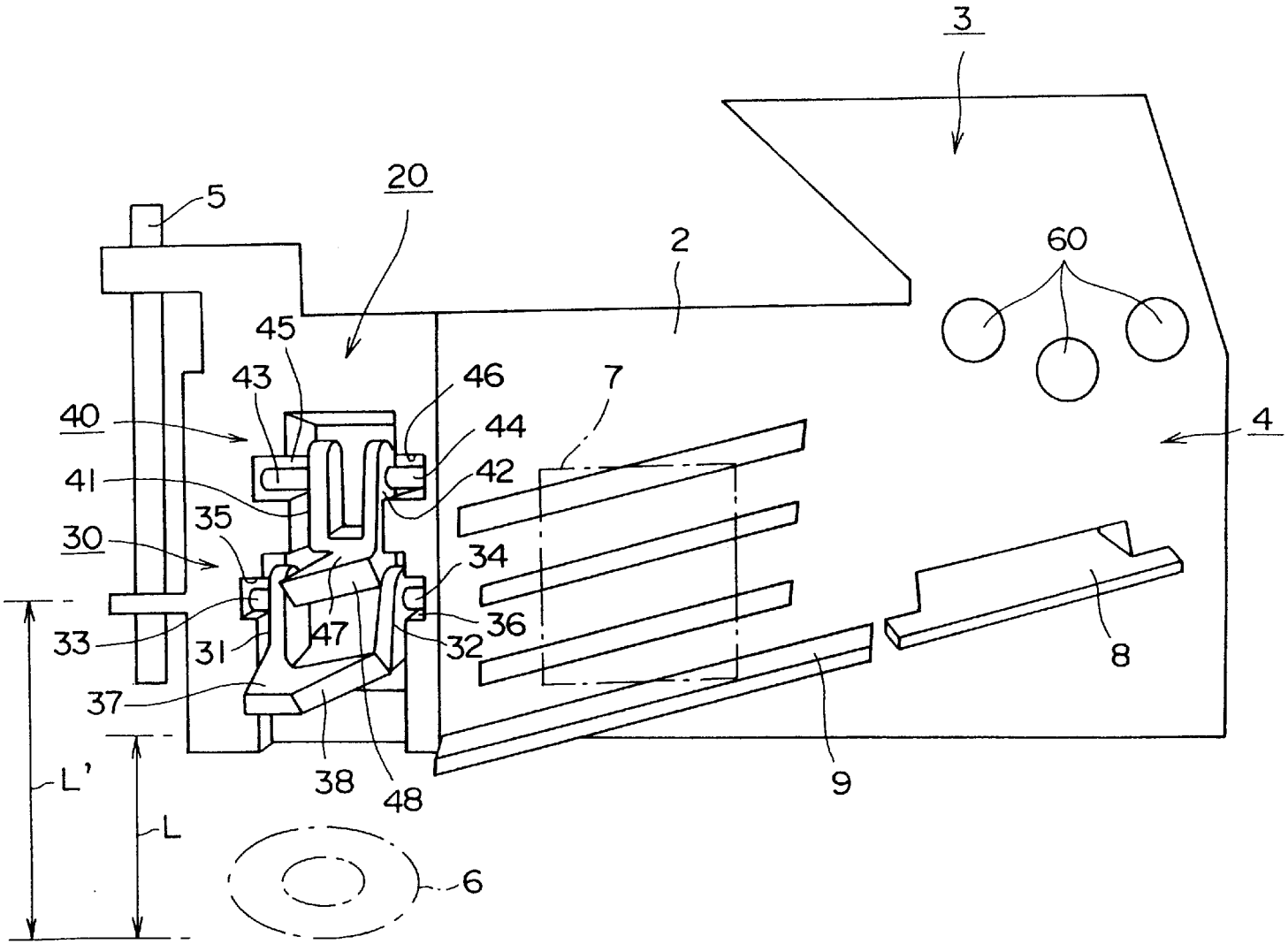
FIG. 1 is a front view of a gate plate showing a coin pullout prevention lever in accordance with the present invention.
Figure 6:
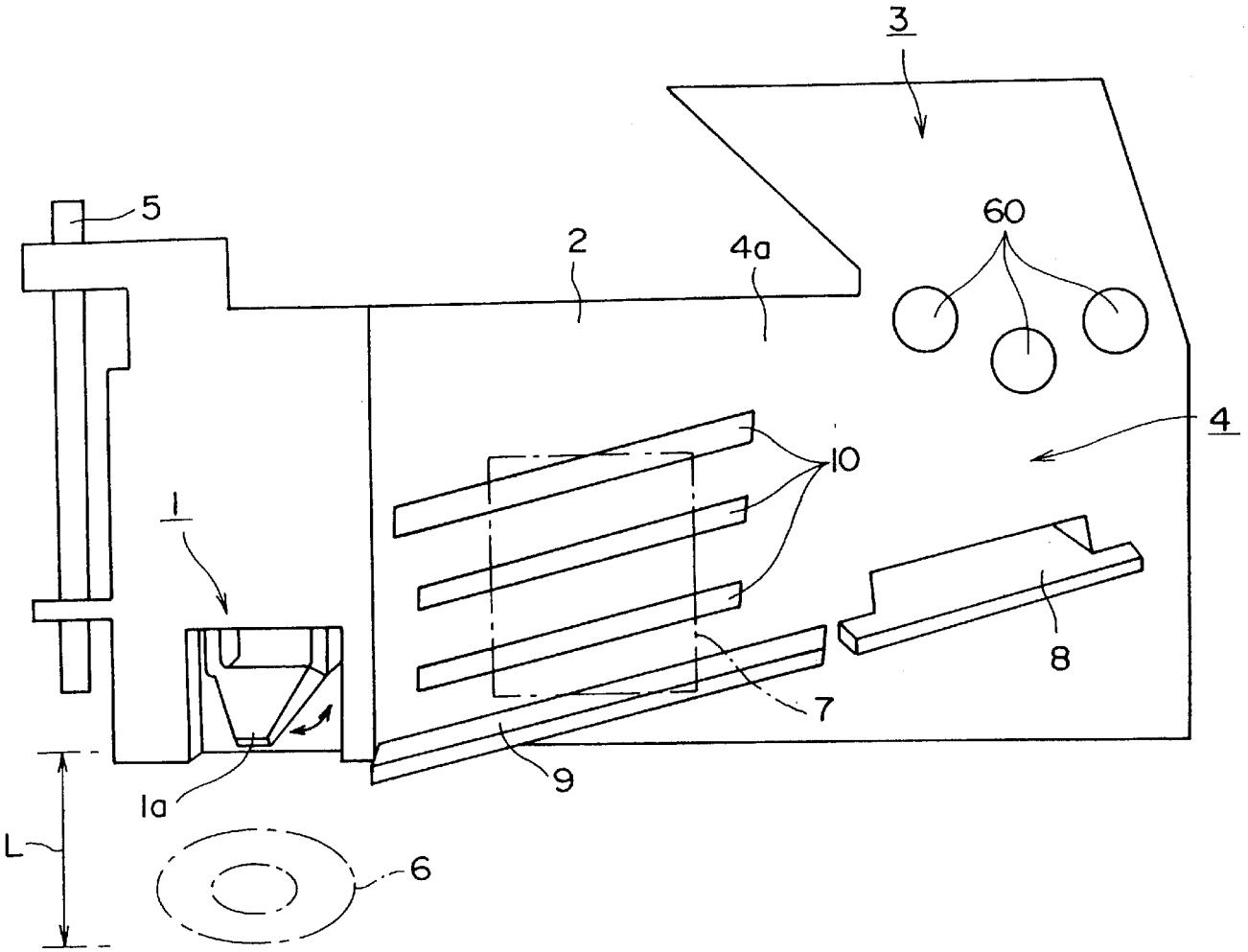
FIG.6 PRIOR ART
FIG. 6 is a front view of a gate plate showing a conventional coin pullout prevention lever.
Figure 7:
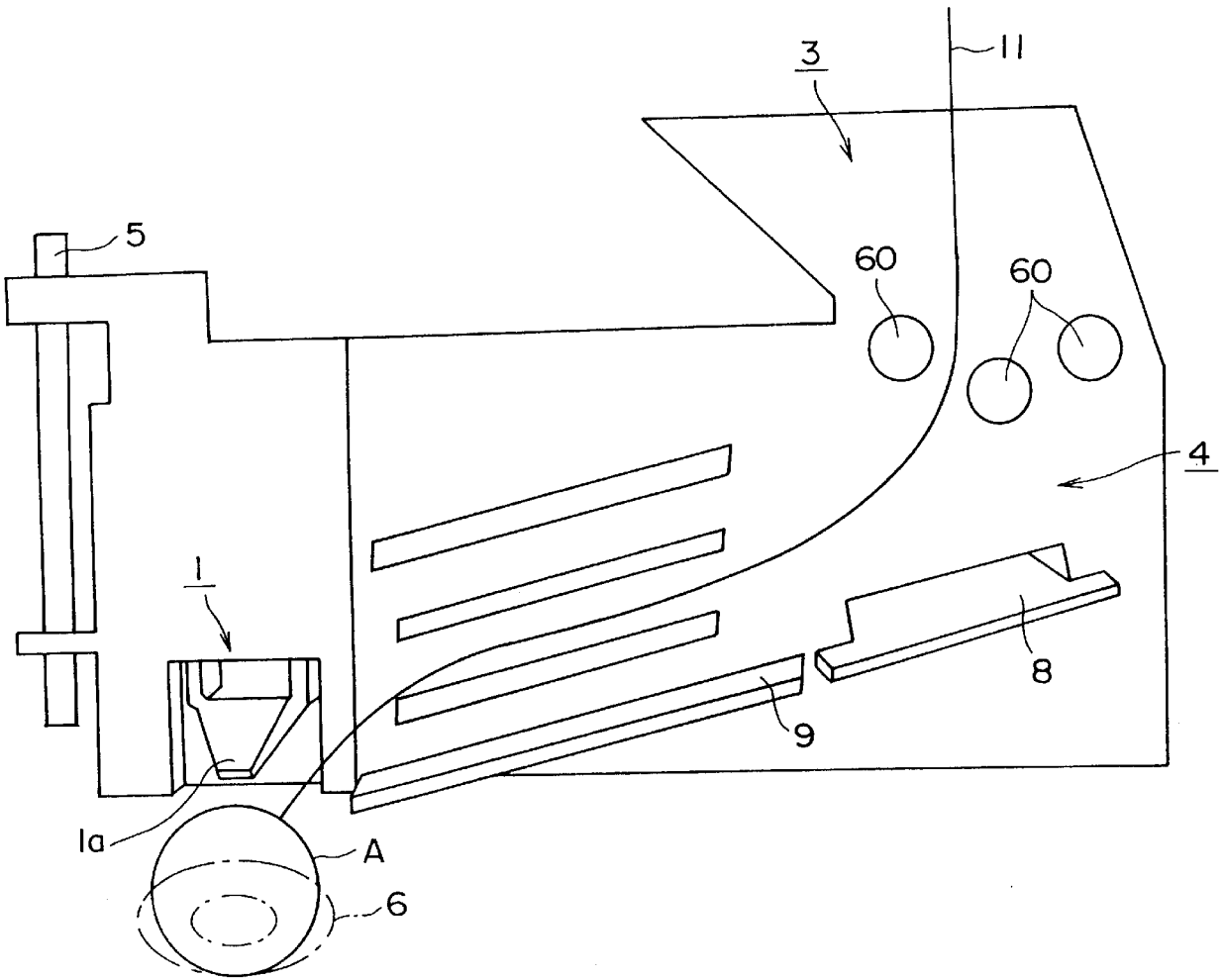
FIG.7 PRIOR ART
FIG. 7 is a front view of a gate plate showing the operation of the conventional coin pullout prevention lever.
Figure 8:
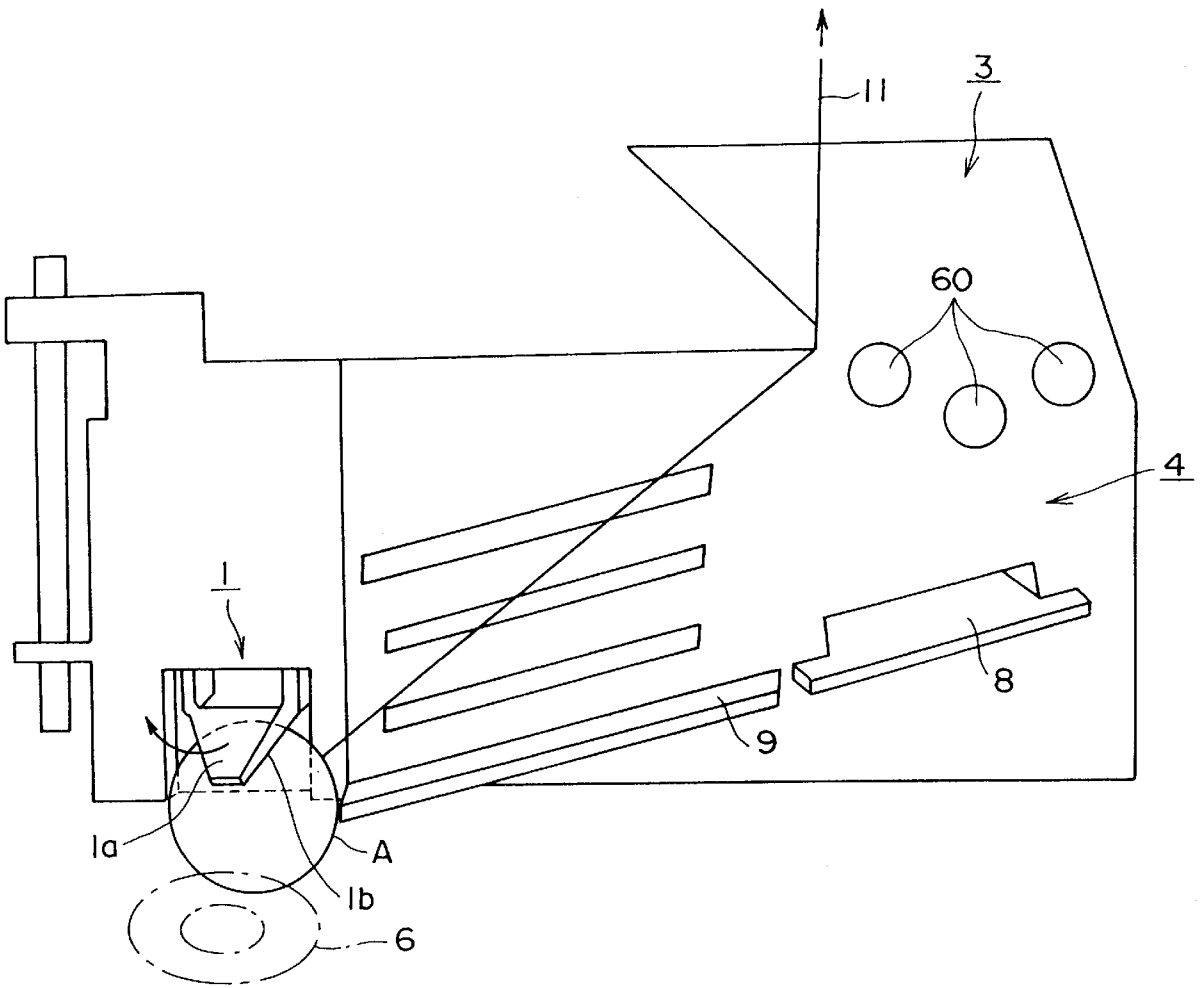
FIG.8 PRIOR ART
FIG. 8 is a front view of a gate plate showing the operation of the conventional coin pullout prevention lever.
Figure 9:
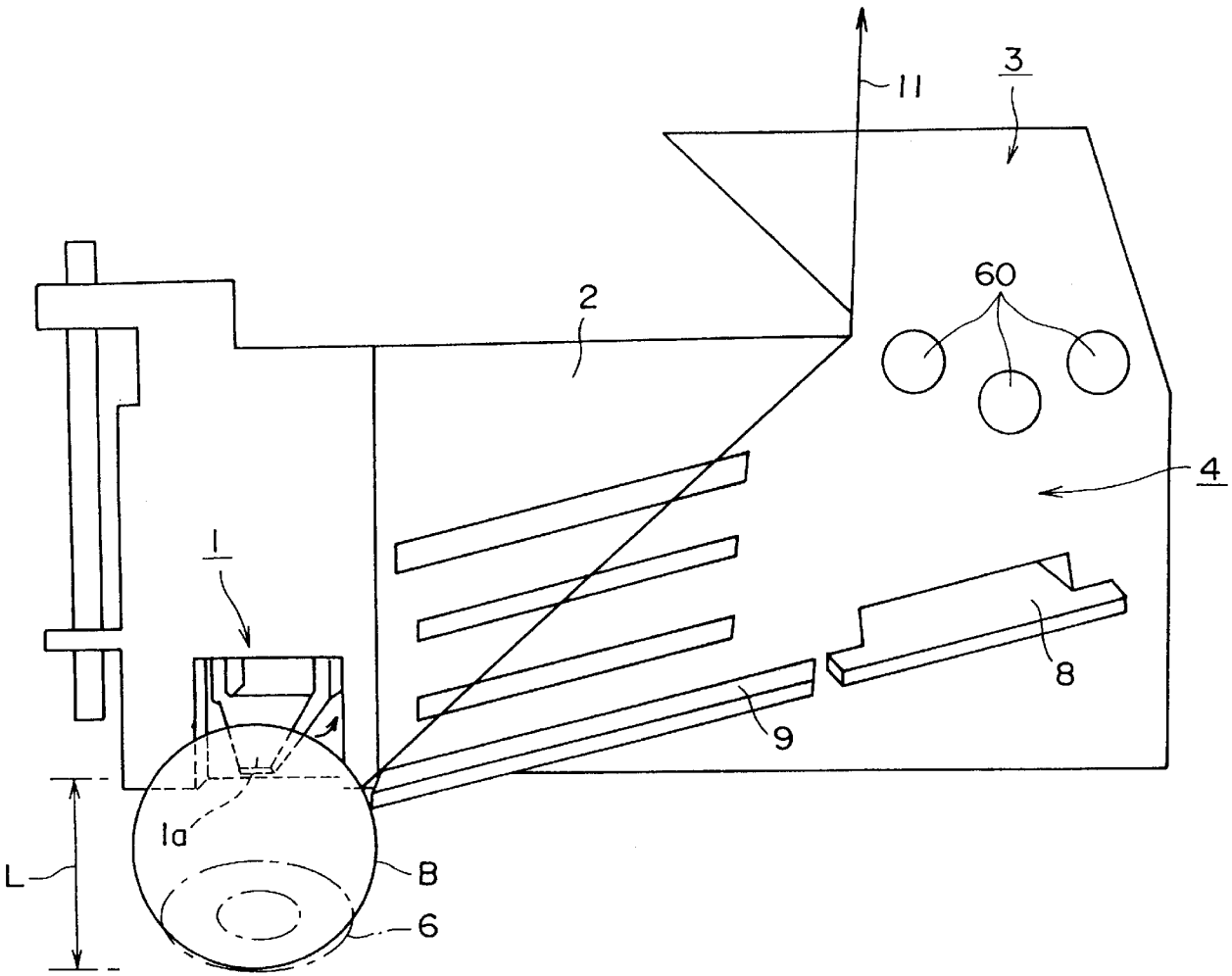
FIG.9 PRIOR ART
FIG. 9 is a front view of a gate plate showing the operation of the conventional coin pullout prevention lever.
Figure 10:
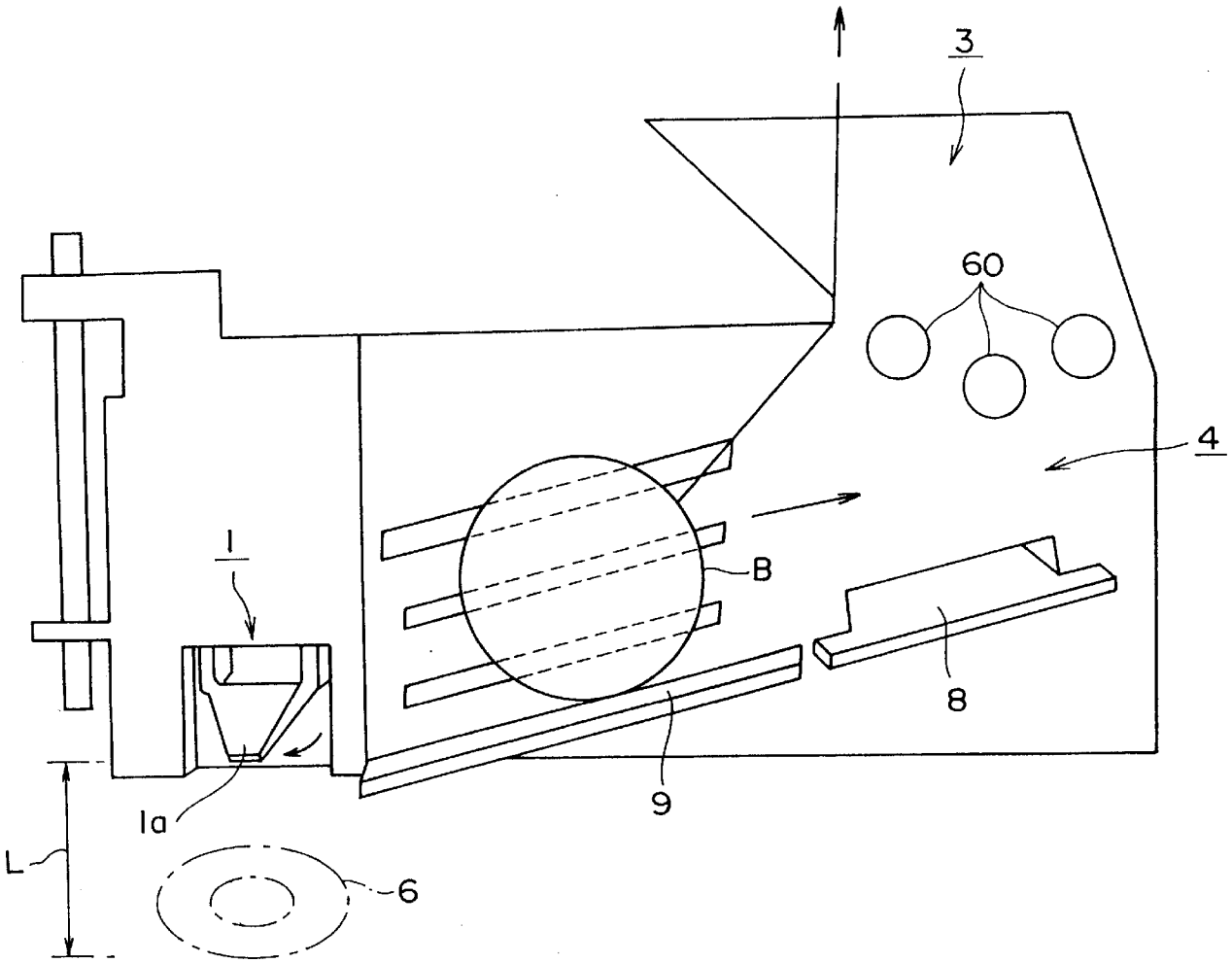
FIG.10 PRIOR ART
FIG. 10 is a front view of a gate plate showing the operation of the conventional coin pullout prevention lever.
Figure 11:
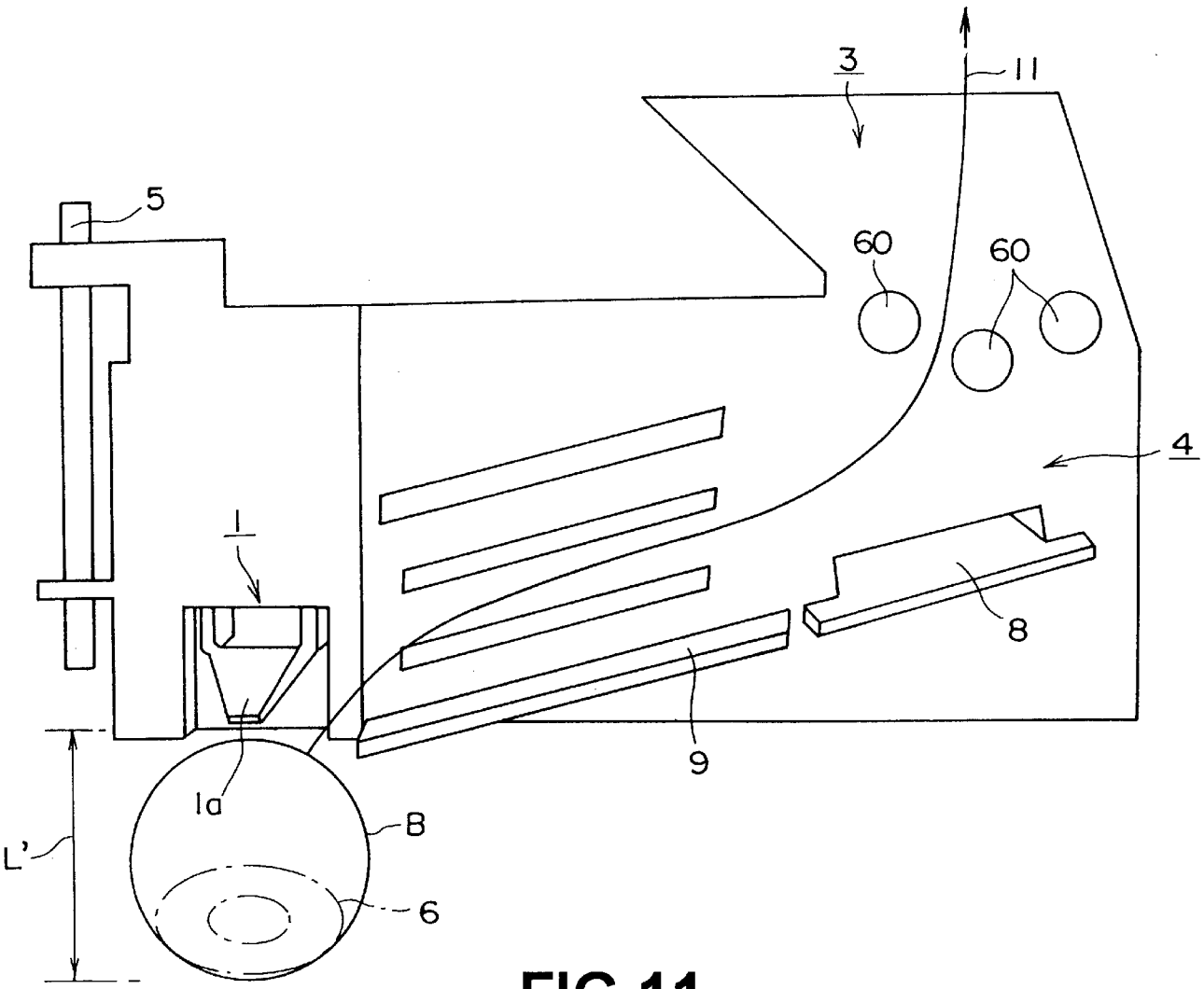
FIG.11 PRIOR ART
FIG. 11 is a front view of a gate plate showing the operation of the conventional coin pullout prevention lever.
Figure 12:
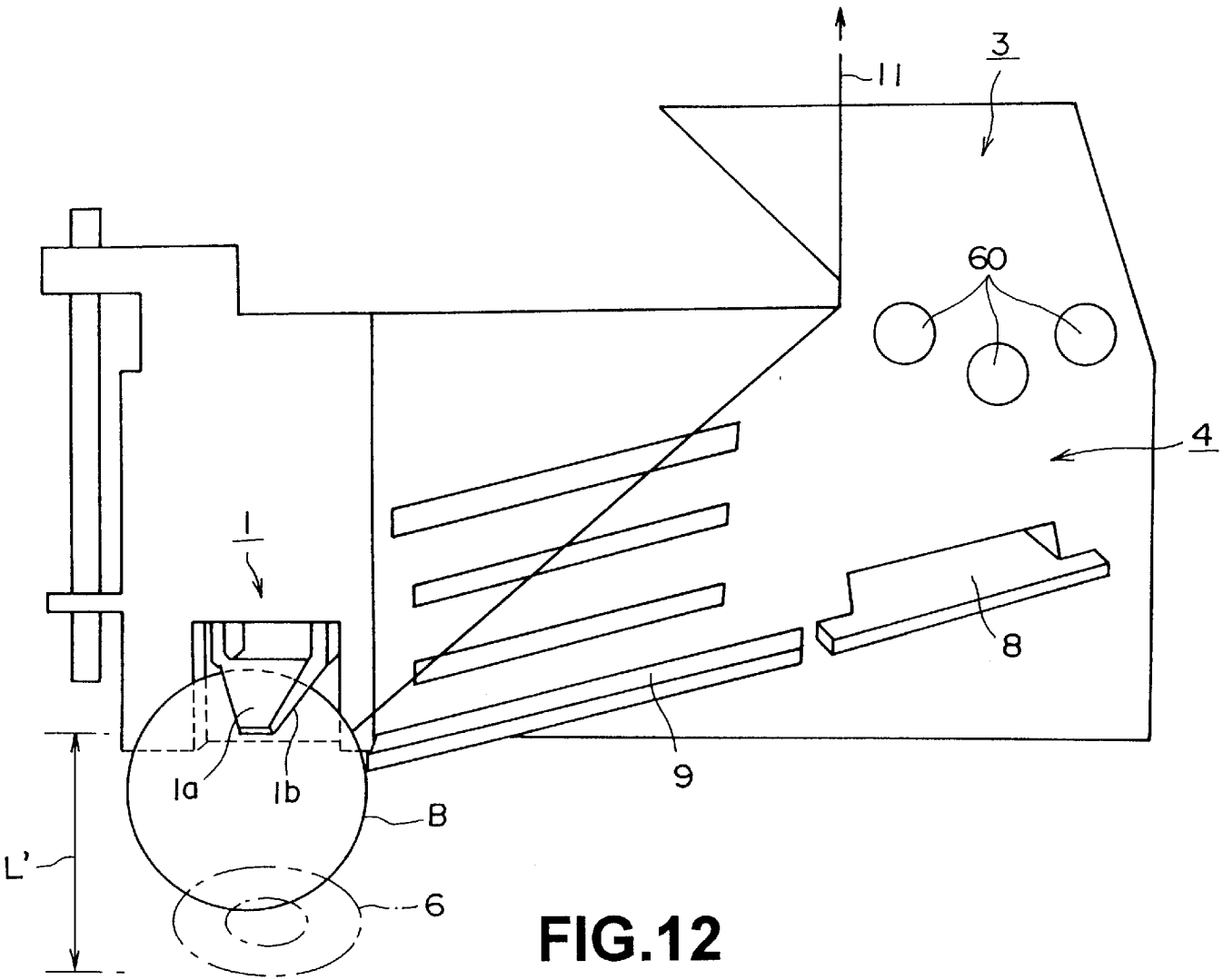
FIG.12 PRIOR ART
FIG. 12 is a front view of a gate plate showing the operation of the conventional coin pullout prevention lever.

FIG. 1 is a front view of a gate plate 2 provided with a coin pullout prevention lever 20 in accordance with the present invention. Elements identical to the ones in FIG. 6 are denoted by the same numerals.

The coin pullout prevention lever 20 includes a first coin pullout prevention lever 30 arranged downstream from a coin guiding path 4, and a second coin pullout prevention lever 40 arranged above the first coin pullout prevention lever 30.

The cross-section of the first coin pullout prevention lever 30 is substantially U-shaped, and the shafts 33 and 34 protrude from the end portions of its sides 31 and 32.

The shafts 33 and 34 are fitted in and supported by corresponding bearing portions 35 and 36, which are concave portions formed in the gate plate 2, so that the first coin pullout prevention lever 30 is supported in a manner that it can swing freely around the shafts 33 and 34 towards a main plate (not shown in the drawings) of the coin sorting device, which is arranged in opposition to the front surface of the gate plate 2.

In its initial position, a tip 37 of the first coin pullout prevention lever 30 protrudes towards the opposing main plate, due to its own weight.

An oblique face 38 is formed in a surface of the tip 37 of the first coin pullout prevention lever 30 that faces the upstream side of the coin guiding path 4, so that when a coin rolling down the coin guiding path 4 hits this lever tip 37, the lever tip 37 is pushed towards the gate plate 2 and the coin falls smoothly downward.

The second coin pullout prevention lever 40, which is arranged above the first coin pullout prevention lever 30, also has a substantially U-shaped cross-section like the first coin pullout prevention lever 30, the shafts 43 and 44 protrude from end portions of its sides 41 and 42, and the shafts 43 and 44 are fitted in and supported by corresponding bearing portions 45 and 46 at corresponding positions, which are formed in the gate plate 2.

Further, the second coin pullout prevention lever 40 is also supported in a manner that it can swing freely around the shafts 43 and 44 towards a main plate (not shown in the drawings) of the coin sorting device, which is arranged in opposition to the main surface of the gate plate 2. And, in its initial position, a tip 47 of the second coin pullout prevention lever 40 protrudes towards the opposing main plate, due to its own weight.

Also, an oblique face 48 is formed in a surface of the tip 47 of the second coin pullout prevention lever 40 that faces the upstream side of the coin guiding path 4, so that when a coin rolling down the coin guiding path 4 hits this lever tip 47, the lever tip 47 is pushed towards the gate plate 2 and the inserted coin falls smoothly downward.

In this coin pullout prevention lever 20, the distance between the tip 37 of the first coin pullout prevention lever 30 and a pass sensor 6 is set to L, and the distance between the tip 47 of the second coin pullout prevention lever 40 and a pass sensor 6 is set to L' (with L'>L).

The following is an explanation of the operation of this coin pullout prevention lever 20.

Figure 2:
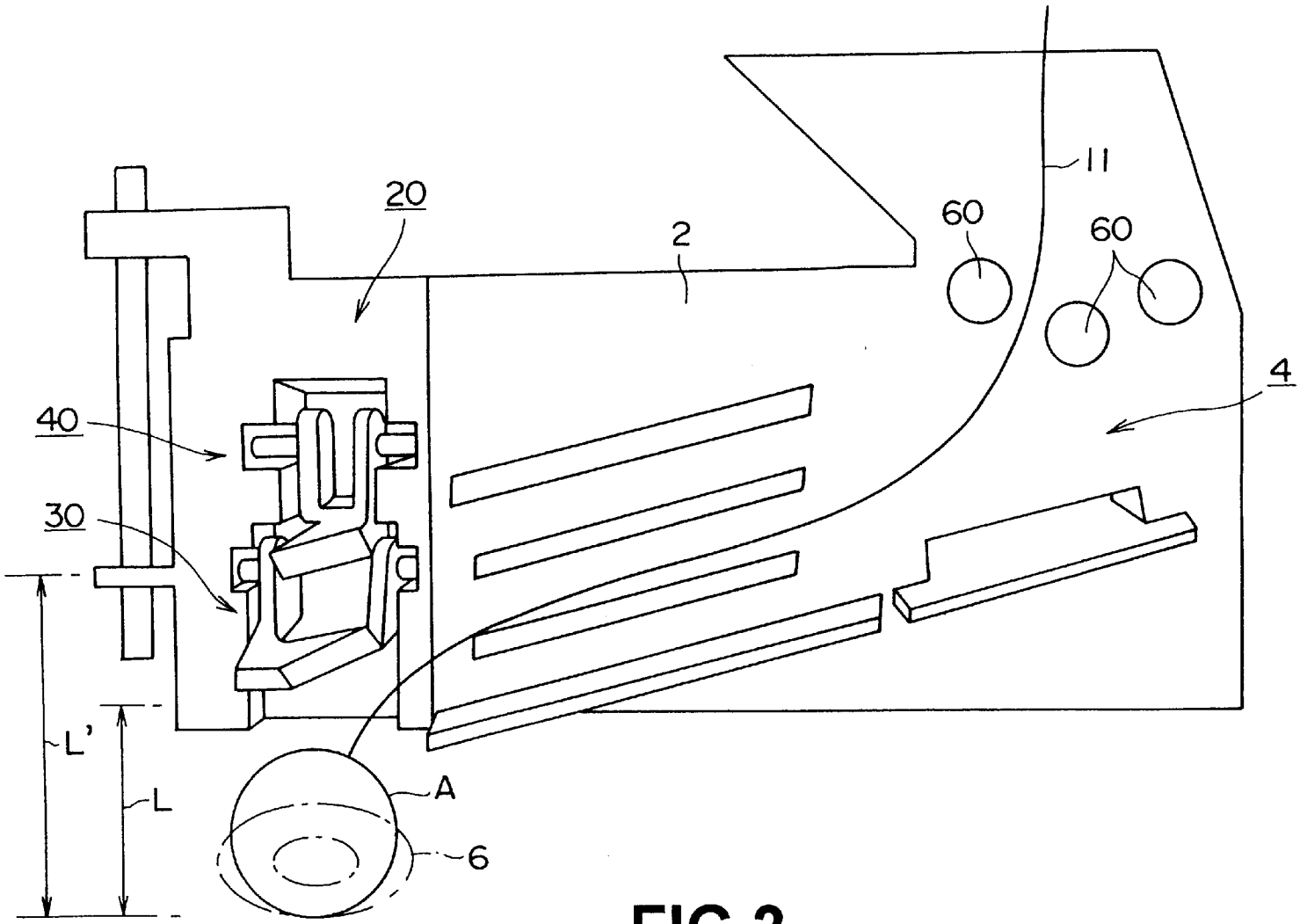
FIG. 2 is a front view of a gate plate showing the operation of a coin pullout prevention lever in accordance with the present invention.
Figure 3:
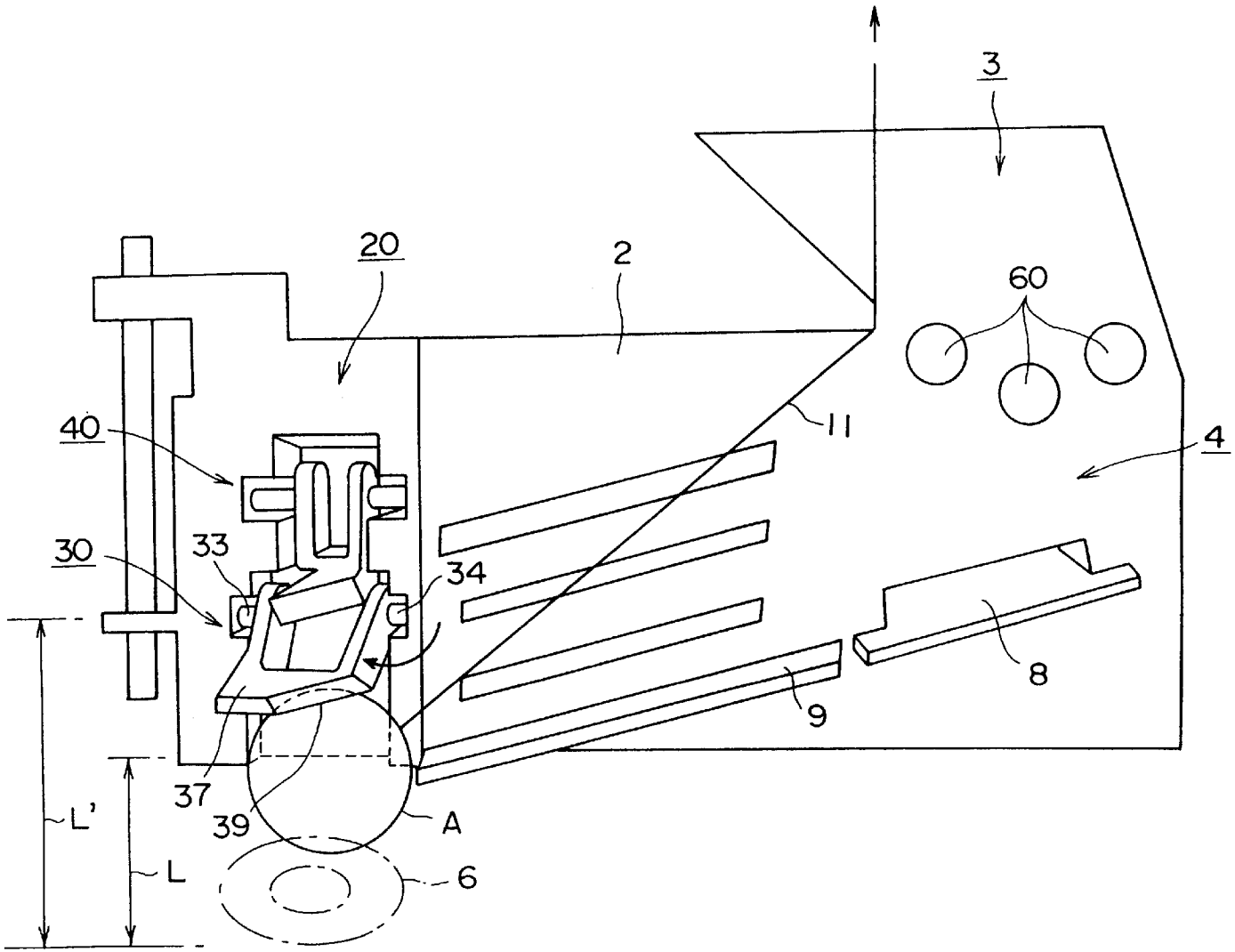
FIG. 3 is a front view of a gate plate showing the operation of a coin pullout prevention lever in accordance with the present invention.

Referring to FIG. 2, when an inserted coin A (whose diameter is smaller than L) attached to a string 11 has rolled down the coin guiding path 4, fallen from its downstream edge and passed the pass sensor 6, the insertion of the coin is detected. Subsequently, as shown in FIG. 3, if anyone tries to pull out the coin A with the string 11, the first coin pullout prevention lever 30 returns to its initial position, and the coin A to be pulled out with the string 11 engages a tip rear face 39 of the first coin pullout prevention lever 30, thereby preventing the coin A from being pulled out.

When the first coin pullout prevention lever 30 is engaged by the coin A, it rotates clockwise around the shafts 33 and 34, but this rotation is blocked when the tip 37 of the first coin pullout prevention lever 30 abuts the main plate (not shown in the drawings) arranged on the front surface of the gate plate 2.

Figure 4:
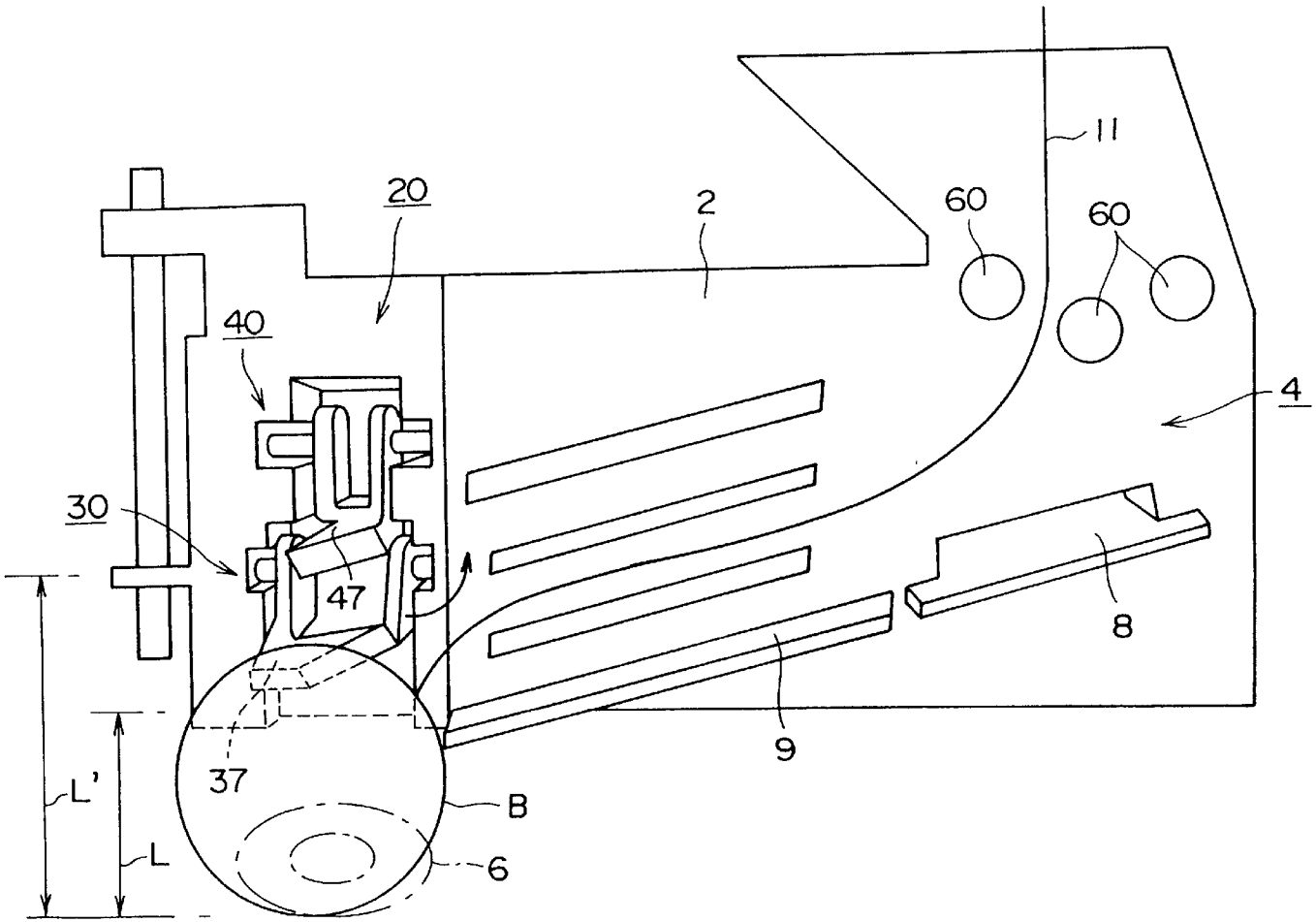
FIG. 4 is a front view of a gate plate showing the operation of a coin pullout prevention lever in accordance with the present invention.
Figure 5:
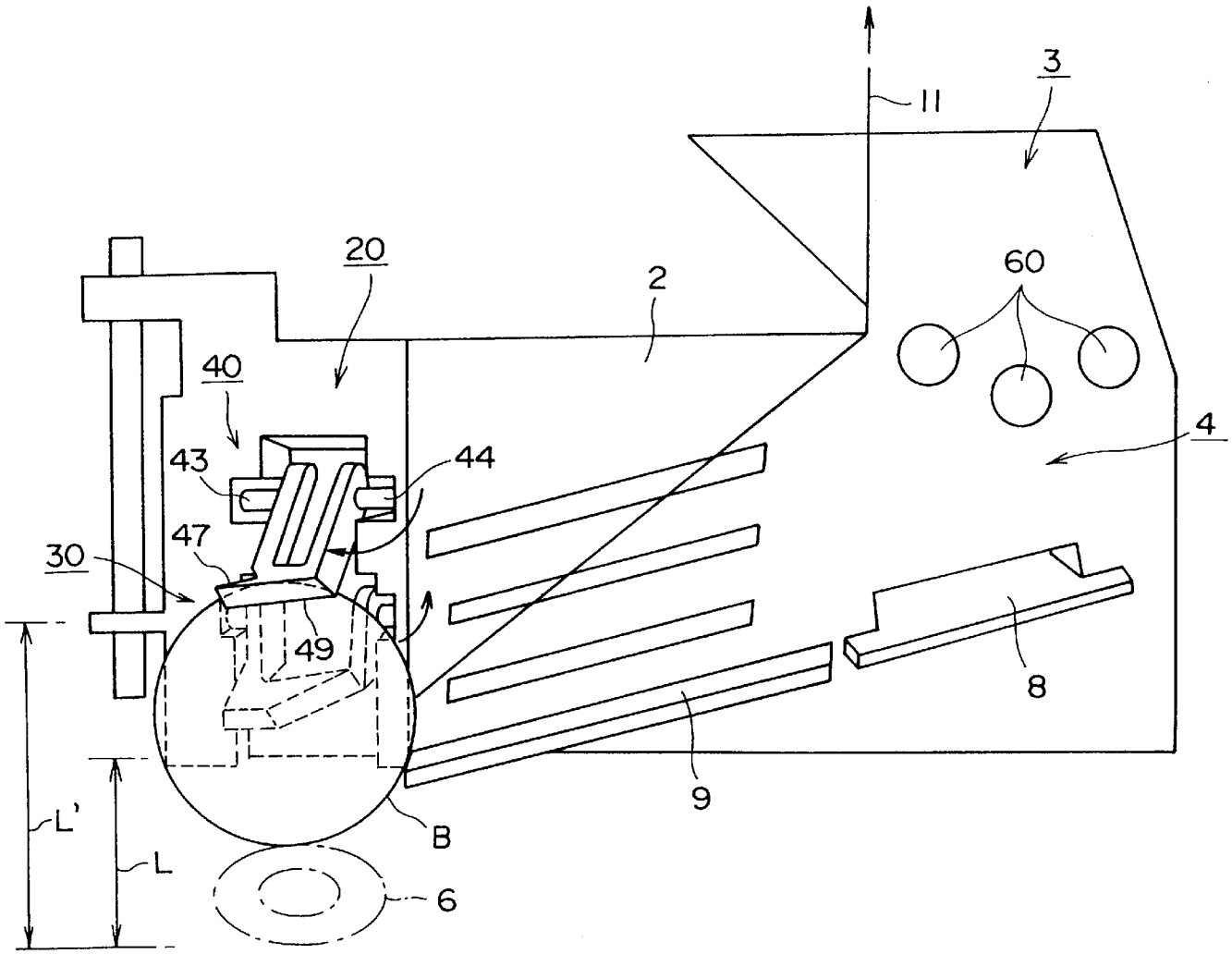
FIG. 5 is a front view of a gate plate showing the operation of a coin pullout prevention lever in accordance with the present invention.

Referring to FIG. 4, when on the other hand an inserted coin B (whose diameter is larger than L but smaller than L') attached to a string 11 has rolled down the coin guiding path 4, fallen from its downstream edge and passed the pass sensor 6, thereby detecting the insertion of the coin, then the tip 37 of the first coin pullout prevention lever 30 stays pushed towards the gate plate 2. If, in this situation, anyone pulls the string 11 in arrow direction as shown in FIG. 5, and tries to pull out the coin B with the string 11, then the coin B engages a tip rear face 49 of the second coin pullout prevention lever 40, thereby preventing the coin B from being pulled out, because the tip 47 of the second coin pullout prevention lever 40 has already returned to its initial position.

Also when the second coin pullout prevention lever 40 is engaged by the coin B, it rotates clockwise around the aforementioned shafts 43 and 44, but this rotation is blocked when the tip 47 of the second coin pullout prevention lever

40 abuts the main plate (not shown in the drawings) arranged on the front surface of the gate plate 2.

This embodiment has been explained only for the case that one separate second coin pullout prevention lever 40 is arranged above the first coin pullout prevention lever 30. However, the present invention is not limited to this embodiment, and it is also possible to arranged one or more second coin pullout prevention levers 40 at different positions. As long as the tips of the coin pullout prevention levers are arranged at different positions, there is no limitation of their number and positional arrangement relative to the first coin pullout prevention lever to the above-described embodiment.

As has been explained above, with a coin pullout prevention lever in accordance with the present invention, one coin pullout prevention lever is arranged near another coin pullout prevention lever whose tip position is different, so that the pulling out of coins of different diameters can be prevented reliably.

Further, as for the coin sorting device, the pulling out of coins of various diameters can be prevented without changing the position of the pass sensor. This eliminates the need to manufacture different types of coin sorting devices with pass sensors being arranged at different positions according to the diameters of the coins whose pulling out is to be prevented. Since the common coin sorting device can be used, a considerable reduction of cost for the manufacture of the coin sorting device becomes possible.

INDUSTRIAL APPLICABILITY

The present invention is suitable for a coin pullout prevention lever that prevents the pulling out of coins with various diameters without altering the basic design of a coin sorting device.

What is claimed is:

1. A coin pullout prevention lever of a coin sorting device, which allows passage of inserted coins while preventing a backflow of the coins that have passed, characterized in that around one coin pullout prevention lever, another coin pullout prevention lever with tip position thereof being different from that of said one coin pullout prevention lever is arranged.

2. The coin pullout prevention lever of a coin sorting device according to claim 1, characterized in that the coin pullout prevention levers have substantially U-shaped cross-section, and are supported rotatably around respective shafts.

3. The coin pullout prevention lever of a coin sorting device according to claim 1, characterized in that the coin sorting device has a main plate and a gate plate which opens or covers the main plate, the coin pullout prevention levers being arranged in the gate plate.

4. The coin pullout prevention lever of a coin sorting device according to claim 1, characterized in that the coin pullout prevention levers are arranged one above another in vertical direction.

* * * * *